United States Patent [19]

Kröger et al.

[11] 4,033,315

[45] July 5, 1977

[54] IGNITION DISTRIBUTOR CONSTRUCTION FOR INTERNAL COMBUSTION ENGINES

[75] Inventors: Uwe Kröger, Hofingen; Friedrich Jaki, Erdmannhausen; Hartmut G. Brammer, Vaihingen, Enz; Karl Ehrmann, Stuttgart; Herbert Mägdefrau, Sonthofen; Günter Brand, Stuttgart; Harald Kalippke, Hohenacker; Rolf Rink, Markgroningen, all of Germany

[73] Assignee: Robert Bosch GmbH, Stuttgart, Germany

[22] Filed: Oct. 9, 1975

[21] Appl. No.: 621,018

[30] Foreign Application Priority Data

Oct. 25, 1974 Germany ..... 2450753

[52] U.S. Cl. ..... 123/146.5 A; 123/148 R; 200/19 R

[51] Int. Cl.[2] ..... F02P 7/02

[58] Field of Search ..... 123/146.5 A, 148 R, 123/146.5 R; 200/19 R, 31 A

[56] References Cited

UNITED STATES PATENTS

| | | | |
|---|---|---|---|
| 1,663,207 | 3/1928 | Mallory | 123/146.5 A |
| 2,016,669 | 10/1935 | Davis, Jr. | 123/146.5 A |
| 3,220,395 | 11/1965 | Julian et al. | 123/146.5 A |
| 3,446,198 | 5/1969 | Simko | 123/146.5 A X |
| 3,646,922 | 3/1972 | Spalding | 123/146.5 A X |

*Primary Examiner*—C. J. Husar
*Assistant Examiner*—Tony M. Argenbright
*Attorney, Agent, or Firm*—Flynn & Frishauf

[57] ABSTRACT

To provide an easily manufactured ignition distributor in which two bearings support the distributor shaft, the lower bearing is molded or otherwise secured into the housing structure, whereas the upper bearing is supported on a transversely extending support member, typically a support plate which is seated within the housing, for example bearing against a shoulder, against seating lugs, or the like, so that the entire ignition distributor structure can be constructed with small compact size.

12 Claims, 6 Drawing Figures

IGNITION DISTRIBUTOR CONSTRUCTION FOR INTERNAL COMBUSTION ENGINES

The present invention relates to a distributor and ignition breaker combination structure for use with internal combustion engines, and more particularly to a compact ignition-distributor structure in which the distributor shaft is guided in two spaced bearings.

It has previously been proposed to decrease the size of distributors, particularly the axial length thereof, by providing a distributor with a lower bearing to support the distributor shaft as well as with an upper bearing; thus, a single elongated long bearing to guide the distributor shaft and prevent whipping of the end carrying the distributor rotor can be avoided, and the entire distributor construction can be reduced in size, particularly in axial length. The distributor structure is, therefore, of smaller size and can be fitted into engine compartments in which space is at a premium.

It has previously been proposed to construct ignition distributors with two bearings, in which the upper bearing is secured in a cylinder portion which is fitted to the side of the distributor normally carrying the distributor cap. The cylindrical portion is secured to the distributor structure by external eyes and screws connected to the eyes. The aim of reducing the size of the distributor is thus achieved only partially since the cylindrical portion increases the overall length and the projecting eyes increase the outline of the distributor strucutre. Such structures, additionally, are comparatively difficult to make and to assemble and require complicated castings or moldings in order to manufacture such structures while still holding assembly operations at a reasonable level.

It is an object of the present invention to provide an ignition breaker and distributor structure which is of compact size, can be manufactured easily, and does not require complicated assembly steps.

Subject matter of the present invention: Briefly, the inner wall of the housing of the distributor structure is used as a support surface for a bearing support located at the upper portion of the distributor shaft; in accordance with a feature of the invention, the housing is formed with a shoulder or with internally projecting support abutments against which a bearing support plate can bear; the bearing support plate, itself, can easily be held in position by a snap ring, or other similar resilient elements.

Figure 1:
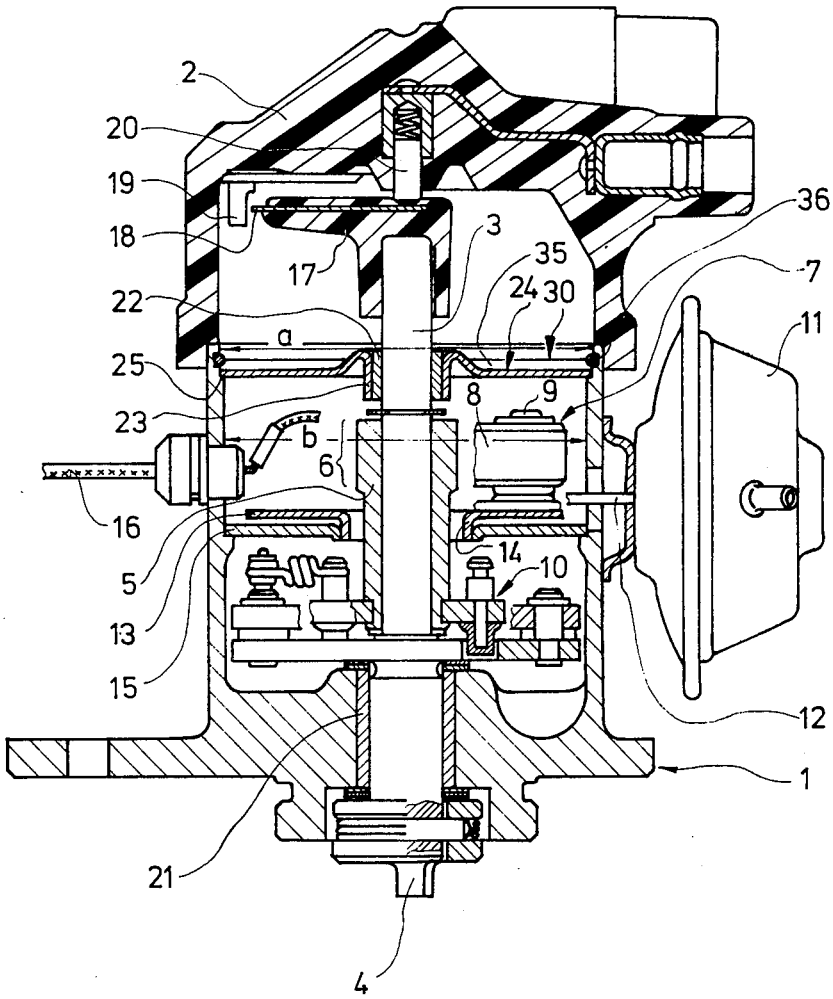
Figure 2:
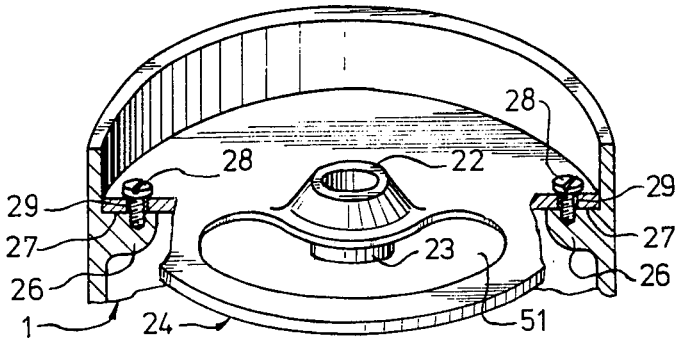

The invention will be described by way of example with reference to the accompanying drawings, wherein:

FIG. 1 is a schematic longitudinal sectional view through an ignition distributor-breaker construction; and FIGS. 2 to 6 are schematic perspective fragmentary views, partly in section, of the housing portion adjacent the bearing support plate, and illustrating various ways of securing the bearing plate in position within the housing.

The ignition distributor-breaker structure (FIG. 1) is adapted for connection to the ignition system of an internal combustion engine (not shown). The distributor has a generally cylindrical housing 1 over which a cap 2 of insulating material can be snapped. Cap 2 is formed with the usual connections for the secondary of the ignition cable as well as for the spark plug ignition cables. A shaft 3 passes through the ignition distributor; shaft 3 is formed at its lower end with a drive lug 4; other similar drive attachments may be used, such as keys, or the like. Lug 4 couples the shaft 3 to the rotating portion of the distributor connecting shaft secured to the internal combustion engine, and rotating synchronously with rotation of the internal combustion engine, for example by being connected to the cam shaft thereof. A sleeve 5 surrounds the shaft 3 within the housing 1. The end portion 6 of sleeve 5 is cam-shaped to form the breaker cam to operate the breaker contacts 7. Since these breaker contacts 7 may be conventional, only the movable arm 8 and the bearing assembly 9 of the breaker contacts are shown. The breaker contact 8 is movable by the cam 6 on sleeve 5 counter the force of a spring (not shown) in a plane transverse to the plane of the drawing, that is, in a plane extending transversely to the axis of shaft 3. Ignition is controlled by breaking of the contact between arm 8 and a fixed contact (not shown) as well known.

A centrifugal controller 10 is connected to shaft 3 on the one hand, and to the sleeve 5 on the other, in order to control spark advance or retardation as a function of engine speed.

A vacuum diaphragm 11, connected to the induction pipe of the engine, or to the carburetor thereof, controls the ignition instant, that is, spark advance or retardation, with respect to loading on the engine. The diaphragm chamber 11 is connected to an operating rod 12 which rotates the support plate 13 on which the breaker contact assembly 17 is mounted with respect to the sleeve 5, and hence with respect to the cam positions thereon. The breaker support plate 13 is secured on a fixed support plate 15 located in the housing, for example by being necked over, as seen at 14.

Cable 16 connects the breaker contact 7 to the remainder of the ignition system of the engine (not shown).

The ignition rotor 17 is fitted at the end portion of shaft 3. Rotor 17 is made of insulating material, and has a contact finger 18 embedded therein. Fixed electrodes 19 are connected to sockets for the ignition systems. The high-voltage connection from the ignition coil is connected to a center electrode 20 so that, when the ignition coil provides a high-voltage pulse, the voltage pulse is transmitted from contact 20 to finger 18, then to spark over to the fixed contact 19 for conduction to the appropriate spark plug.

Shaft 3 must be guided accurately in order to prevent whipping of the upper end portion of the shaft located within the sleeve 5 and particularly the upper cam portion 6, and of the terminal end to which rotor 17 is attached.

Shaft 3 is reliably guided by providing two bearings; a first bearing 21 is located in the bottom portion of the housing 1; a second bearing 22 is located close to the open end of housing 1, that is, close to the attachment point of the cap 2 to the housing 1.

Bearing 1 may be a self-lubricating sleeve bearing, molded into the housing 1, as shown. The second bearing 22 may also be a cylindrical sleeve bearing, for example self-lubricating, which is fixed in a central cylindrical portion 23 of a support member 24. The outer shape of the bearing 23 is not critical; it may, for example, be somewhat bowed or bulged or drum-shaped, and can be rigidly secured in the support 24, or with some slippage so as to be self-aligning.

To locate the bearing 22 and its support wholly within the outline of the housing 1, without any portions projecting substantially therefrom, the inner wall of housing 1 is so formed in the region of the upper portion, that is, the free end face thereof, that the support 24 can be securedly held within the housing wall 1, to thereby secure bearing 22 in fixed position within the housing 1 and without requiring any external attachment arrangements or space therefor. The plate 24 is held in the housing against shoulder 25 by a holding element 30.

The support 24 is preferably constructed as a plate which may be sheet steel. Little space is required for sheet steel, while providing substantial stability. If the signal source for the ignition pulses is not a mechanically operated breaker arrangement 7, as shown, but rather uses a magnetic transducer, then support 24 should be of non-magnetic material, for example aluminum or strong plastic.

Support 24 is itself supported within the inner wall of housing 1; it may be supported throughout its entire circumference, or only at selected support positions, or over support sectors.

In a simple form, support 24 is fitted against a shoulder formed in the wall of housing 1. The terminal end of housing 1 is slightly enlarged, that is, to have a clear dimension a which is somewhat greater than the clear dimension b just below the end portion of dimension a. The transition between the different dimensions forms a shoulder 25 which provides a seat for plate 24.

In some constructions it may not be possible to reduce the thickness of the wall of housing 1 to provide for shoulder 25; if such is the case, then internal projections 26 are formed on the inner wall of housing 1 (see FIG. 2) to provide a flat surface 27 against which plate 24 may seat. The projection 26 may extend circumferentially or be formed as internally projecting lugs. The plate 24 can readily be secured to the projection or projections 26 by screws 28 passing through holes 29 in the plate 24, and screwed into the respective projection or projections.

Figure 3:
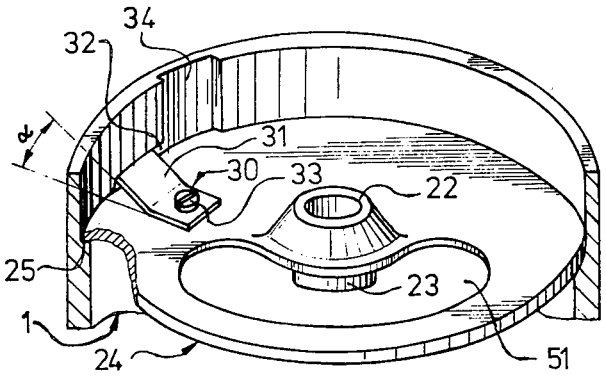

Assembly, disassembly and removal of plate 24 is made particularly simple by using a snap connection, as shown in FIG. 3. The holding element 30 is screwed by means of screws 33 to plate 24. The holding element 30 engages into a notched portion of the inner wall of housing 1 and presses the plate 24 against shoulder 25 (or, for example, projection 26). Preferably more than one element 30 is secured to plate 24, located around the circumference thereof; only one of them is shown in FIG. 3. The element 30 is preferably a leaf spring 31 which engages in a groove 32 formed in the inner wall of housing 1, and extending circumferentially thereof up to a stop or end position, that is, not completely around the distributor housing. The end portion of leaf spring 31 forms an acute angle $\alpha$ with the plane of the support plate 24. Upon assembly, screw 33 can be loose; when screw 33 is tightened, leaf spring 31 will bear with its end portion against the opposite surface of the groove 32 and thus securely hold plate 24 in position. An axial groove 34 is preferably formed in the inner wall of the housing 1 to permit easy insertion of the plate 24, with screw 33 loose. The width of groove 34 is preferably slightly larger than the width of leaf spring 31, so that there is ample space for insertion of plate 24 with the spring 31 pre-assembled.

The plate 24 need not additionally be fixed against rotation if the groove 32 extends from groove 34 in the direction of rotation of the shaft 3 and terminates at a stop end.

Figure 4:
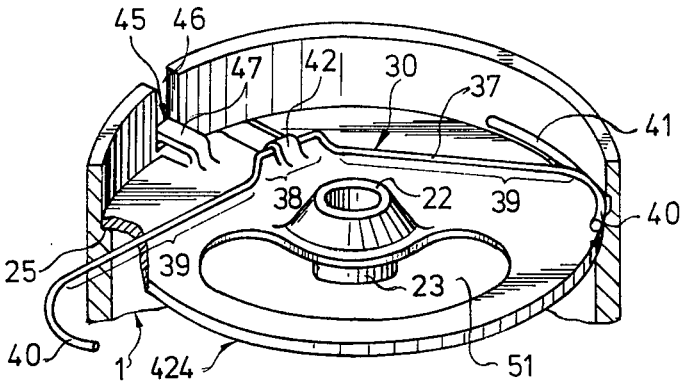
Figure 5:
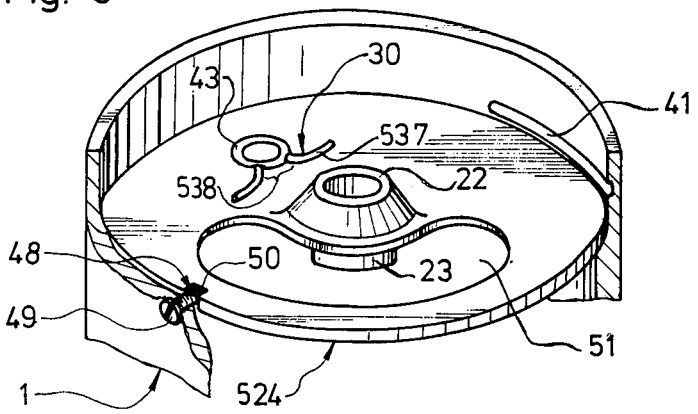

The plate 24 can also be secured in position against its seat in the housing 1 by a circumferential C-ring 35 snapped into a groove 36 (FIG. 1) formed in the inner wall of the housing. The C-ring 35 is preferably made of a circular cross section wire, or at least partially circular cross section wire. FIG. 4 illustrates an arrangement in which a spring 37 is used which has two projecting spring arms 39 joined at a central portion 38. The spring arms 39 are bent over at the ends to form end portions 40 which engage in grooves 41 formed in the inner wall of the housing and extending for a limited distance only. The central portion 38 of the spring 37 is secured to plate 424 by means of a lug 42, punched from plate 424 and in which the center portion 38 of the spring is inserted before the lug 42 is bent thereover to hook over the central portion 38 and hold it in position against plate 424. If it is not desired to substantially deform the support plate, then, as shown in FIG. 5, the central portion 538 of the spring is bent to form an eye and the spring 537 is secured by means of an eyelet rivet to the plate 524. Using an eyelet rivet has the advantage that a screwdriver can be passed therethrough; the eyelet rivet can then be so located that it is above the attachment screw which connects the vacuum diaphragm operating rod 12 to the support plate 13 for the breaker contacts 7, so that the diaphragm 12 can be removed from the distributor assembly without disturbing any of the other operating elements of the distributor itself.

Figure 6:
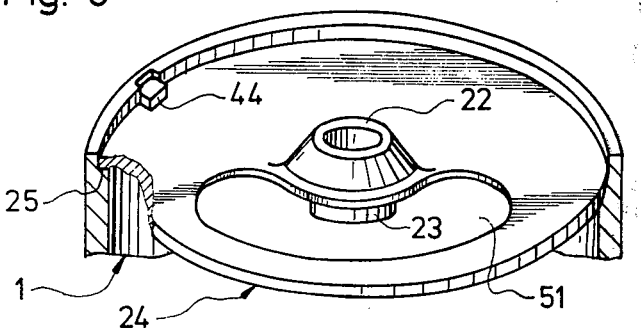

Another way of attaching the plate 24 in housing 1 is illustrated in FIG. 6 in which the end portion of the facing end wall of the housing 1 is deformed as shown at 44, for example by punching or heat deformation, to form a projection which bears against the plate 24. If it is necessary to remove plate 24, then the deformation 44 has to be first removed, for example by breaking it off, and re-deforming another portion of the housing end wall.

It may be necessary to secure the end plate 24 against rotation within housing 1, in order to provide better guidance for shaft 3 within bearing 22. Various arrangements suggest themselves; for example, plate 424 is formed with a projection 45 which forms a strip 47, bent upwardly, and engaging within a notch 46 formed in the housing end wall 1.

It is frequently desirable to maintain the integrity of the housing end wall, for example to prevent contamination by dirt or the like, and to avoid any possibility of impairing the seating and the sealing of the cap 2. A locking lug 48 (FIG. 5) forming a projection from the inner end wall of the housing is then provided, engaging in a matching notch 50 of plate 24. The projection 48 from the inner wall of the housing may be molded-in, or may be a separate element 49, such as a pin fastened therethrough, or a screw, preferably formed with a self-tapping thread, and threaded through the end wall of the housing, as clearly seen in FIG. 5. In another form, the locking lug 48 is a molded-on projection integrally molded with the housing, or subsequently attached or otherwise secured thereto. The projection-recess arrangement need not be formed in the combination of plate 24 and housing 1; the cap 2 and the plate 24 may also be formed with suitable anti-rotation locking arrangements.

Plate 24 is formed with a cut-out 51, the size and position of which are so selected that a new breaker contact assembly can be passed therethrough, if replacement of the breaker contact assembly 7 should be necessary. By suitably shaping the cut-out 51, it is not necessary to remove the distributor rotor 17 and plate 24 when replacing or adjusting the breaker contact assembly 7.

Various changes and modifications may be made, and features described in connection with any one of the embodiments may be used with any of the other embodiments, within the scope of the inventive concept.

We claim:

1. Ignition distributor construction for internal combustion engines having a cup-shaped housing (1) having end walls and including a distributor cap (2), a shaft (3) located within the housing and extending into the distributor, upper and lower bearings (21, 22) located in the distributor, the lower bearing (21) being positioned at the bottom thereof, and the upper bearing being positioned adjacent the upper portion of the shaft;

an upper bearing support plate (24) extending essentially transversely of the housing and to the axis of the distributor shaft (3), said upper bearing (22) being secured to said upper bearing support plate centrally thereof;

an abutment shoulder formed by a section of the inner wall of the housing of increased wall thickness, the upper bearing support plate (24) being located on said shoulder;

a portion of the housing (1) adjacent the upper bearing support plate being upset and deformed to form a holding lug (44) pressing against the upper support plate and pressing the upper support plate (24) against the abutment shoulder formed in the housing;

a breaker contact assembly (7) located beneath said plate (24);

and an opening (51) formed in said plate and having a size sufficient to permit passage of the breaker contact assembly through the opening to permit removal of the breaker contact assembly from the distributor housing and replacement thereof without removal or disturbance of said plate from, or with respect to said housing.

2. Construction according to claim 1, wherein the abutment shoulder (25, 26) within the inner wall of the housing (1) for the upper bearing support element (24) extends at least over substantial portions of the inner wall of the housing.

3. Ignition distributor construction for internal combustion engines having a cup-shaped housing (1) having end walls and including a distributor cap (2), a shaft (3) located within the housing and extending into the distributor, upper and lower bearings (21, 22) located in the distributor, the lower bearing (21) being positioned at the bottom thereof, and the upper bearing being positioned adjacent the upper portion of the shaft;

an upper bearing support plate (24) extending essentially transversely of the housing and to the axis of the distributor shaft (3), said upper bearing (22) being secured to said upper bearing support plate centrally thereof;

an abutment shoulder formed by a section of the inner wall of the housing of increased wall thickness, the upper bearing support plate (24) being located on said shoulder;

said shoulder being extended radially inwardly of the housing to form inwardly extending projections (26) having an upwardly directed support surface (27), the upper bearing support plate (24) being seated against said support surface;

said projections (26) being integral with the inner wall of the housing and being formed with tapped bores;

attachment screws (28) securing the upper bearing support plate (24) to said inwardly extending projections (26);

a breaker contact assembly (7) located beneath said plate (24);

and an opening (51) formed in said plate and having a size sufficient to permit passage of the breaker contact assembly through the opening to permit removal of the breaker contact assembly from the distributor housing and replacement thereof without removal or disturbance of said plate from, or with respect to said housing.

4. Ignition distributor construction for internal combustion engines having a cup-shaped housing (1) having end walls and including a distributor cap (2), a shaft (3) located within the housing and extending into the distributor, upper and lower bearings (21, 22) located in the distributor, the lower bearing (21) being positioned at the bottom thereof, and the upper bearing being positioned adjacent the upper portion of the shaft;

an upper bearing support plate (24) extending essentially transversely of the housing and to the axis of the distributor shaft (3), said upper bearing (22) being secured to said upper bearing support plate centrally thereof;

an abutment shoulder formed by a section of the inner wall of the housing of increased wall thickness, the upper bearing support plate (24) being located on said shoulder;

a leaf spring (31) secured to the plate (24), the housing being formed with a circumferentially extending groove (32), the groove being engaged by said leaf spring;

a screw (30) connecting the leaf spring (31) to the upper bearing support element (24) to selectively tighten or loosen the leaf spring with respect to the support element, the leaf spring having an angled portion with respect to the support element to provide an engagement force tending to press said support plate (24) against the abutment shoulder formed in the housing (1);

a breaker contact assembly (7) located beneath said plate (24);

and an opening (51) formed in said plate and having a size sufficient to permit passage of the breaker contact assembly through the opening to permit removal of the breaker contact assembly from the distributor housing and replacement thereof without removal or disturbance of said plate from, or with respect to said housing.

5. Construction according to claim 4, wherein the inner wall of the housing is formed with an axially extending groove or notch (34) of a size sufficient to receive said leaf spring to permit introduction of said leaf spring into the circumferential groove (32).

6. Ignition distributor construction for internal combustion engines having a cup-shaped housing (1) having end walls and including a distributor cap (2), a shaft (3) located within the housing and extending into the distributor, upper and lower bearings (21, 22) located in the distributor, the lower bearing (21) being positioned at the bottom thereof, and the upper bearing being positioned adjacent the upper portion of the shaft;

an upper bearing support plate (24) extending essentially transversely of the housing and to the axis of the distributor shaft (3), said upper bearing (22) being secured to said upper bearing support plate centrally thereof;

an abutment shoulder formed by a section of the inner wall of the housing of increased wall thickness, the upper bearing support plate (24) being located on said shoulder;

a groove (36) extending at least partly circumferentially in the inner wall of the housing adjacent the upper bearing support plate (24);

a snap spring (35, 37) being received at least in part within said groove;

a breaker contact assembly (7) located beneath said plate (24);

and an opening (51) formed in said plate and having a size sufficient to permit passage of the breaker contact assembly through the opening to permit removal of the breaker contact assembly from the distributor housing and replacement thereof without removal or disturbance of said plate from, or with respect to said housing.

7. Construction according to claim 6, wherein the snap spring has a pair of spread legs (39) and a central portion (38) between said legs, the central portion being secured to the upper bearing support plate (24) at the outer side of the plate, with respect to the bottom of the housing, and the end (40) of said legs engaging in a groove (41) formed in the inner wall of the housing (1).

8. Construction according to claim 7, wherein the plate (424) is formed with a punched-out loop (42), said loop engaging a portion of said spring and securing said spring to the plate.

9. Construction according to claim 7, wherein the spring (37) is formed with a central loop portion, and an open eyelet (43) is provided securing said open loop portion to the plate (524) forming the upper bearing support element.

10. Construction according to claim 6, including projection and recess means (45, 46) formed, respectively, on said upper bearing support plate (424) and said housing (1) to prevent rotation of the plate (424) with respect to the housing (1).

11. Construction according to claim 10, wherein the projection-and-recess means comprises a strip (47) punched from said plate (424) and having an outwardly extending projection; and a recess or notch (46) formed in the housing, the projection projecting from the plate (424) extending into said notch.

12. Construction according to claim 10, wherein the projection-and-recess means comprises a projecting element (48) projecting inwardly from the wall of the housing (1), the recess being formed in the upper bearing support plate.

* * * * *